United States Patent [19]

Maurer

[11] 4,270,687

[45] Jun. 2, 1981

[54] APPARATUS FOR DRIVING FASTENERS

[75] Inventor: Werner Maurer, Nuertingen, Fed. Rep. of Germany

[73] Assignee: Karl M. Reich Maschinenfabrik GmbH, Nuertingen, Fed. Rep. of Germany

[21] Appl. No.: 68,746

[22] Filed: Aug. 23, 1979

[30] Foreign Application Priority Data

Sep. 1, 1978 [DE] Fed. Rep. of Germany ..... 2838194

[51] Int. Cl.[3] ..... B25C 1/04

[52] U.S. Cl. ..... 227/113; 227/112; 227/116

[58] Field of Search ..... 227/112, 113, 114, 116, 227/120, 130

[56] References Cited

U.S. PATENT DOCUMENTS

| | | | |
|---|---|---|---|
| 2,801,415 | 8/1957 | Jenny | 227/130 |
| 3,087,160 | 4/1963 | Doppelt | 227/130 |
| 3,099,837 | 8/1963 | Heilman et al. | 227/130 |
| 3,104,395 | 9/1963 | Grey, Jr. et al. | 227/115 |
| 3,232,511 | 2/1966 | Crooks | 227/130 |
| 3,353,737 | 11/1967 | Howard et al. | 227/130 |
| 3,820,705 | 6/1974 | Beals | 227/113 |
| 3,969,988 | 7/1976 | Maurer | 227/130 |

FOREIGN PATENT DOCUMENTS

| | | | |
|---|---|---|---|
| 419372 | 9/1974 | U.S.S.R. | 227/113 |

*Primary Examiner*—John McQuade
*Attorney, Agent, or Firm*—W. G. Fasse; D. F. Gould

[57] ABSTRACT

The present driver for fasteners such as nails, screws and the like is provided with a separator member operatively located between the ejector channel and a fastener supply magazine. The separator member takes up a fastener arresting position in which the separator member reaches between the shafts of two fasteners and a retracted position in which the separator member releases a fastener for movement into the ejector channel. The separator member cooperates with a holding device which holds a fastener in the ejector channel after release by the separator member and prior to the driving stroke. The holding device may comprise two permanent magnets.

7 Claims, 5 Drawing Figures

APPARATUS FOR DRIVING FASTENERS

BACKGROUND OF THE INVENTION

The present invention relates to an apparatus for driving fasteners such as nails, screws or the like having a shaft. The driving apparatus includes a discharge or ejector channel in which a power driven driver rod is guided between a rest position and a driving position. A magazine holding the fasteners is operatively connected to the ejector channel. A separator device is arranged between the ejector channel and the magazine.

Driving tools of this type are used for driving of bulk type fasteners such as nails, screws, spikes and so forth. These fasteners are made ready for use in the above mentioned magazine connected to the driving apparatus. German Patent Publication (DE-OS) No. 2,511,023 corresponding to U.S. Pat. No. 3,893,610 discloses an apparatus of this type in which the magazine is inclined relative to the ejector channel in such a manner that the nails enter into the ejector channel under the force of gravity. Besides, the central plane of the magazine intersects the longitudinal axis of the ejector channel so that the first nail initially cannot enter into the ejector channel. Only a separator plate operated by an air pressure piston tilts the first nail in such a manner, that it may enter into the ejector channel where it is immediately thereafter driven into the work piece by a driver rod. The separation and feeding of the first nail as well as the punch stroke of the driver rod is accomplished by means of an air pressure sequence control having several valve functions which take place after actuation of the trigger valve.

However, in the known driving tool merely a relatively slow stroke or driving sequence may be accomplished due to the multiple step air pressure sequence control which requires respective valve and piston movements. Such a slow driving sequence is disadvantageous or rather incompatible with an expedient manufacturing operation. The driving sequence becomes even slower, when the valves are dirty or when the lubricating oil becomes rather viscous, for example, due to cold external temperatures. Another disadvantage of the prior device is seen in its substantial price and weight caused by additional valves and pistons. Moreover, the known apparatus is capable of driving nails of the best quality only. Such nails are necessary for a trouble free functioning of the nail supply by means of tilting. Moreover, since the nails are supplied by gravity it is not possible to use the known apparatus for driving nails in an overhead fashion.

OBJECTS OF THE INVENTION

In view of the above it is the aim of the invention to achieve the following objects singly or in combination:

to construct a driving tool of the type mentioned above in which the number of necessary valve functions is minimized and which permits a high driving stroke frequency;

to provide an apparatus of the above type which may be used in any position including an overhead nailing operation;

to provide a possibility of safely using nails or other fasteners of any quality including those of low quality;

to simplify the operational sequence of such driving tools while simultaneously assuring a rapid yet safe operation;

to enable the use of fasteners which are interconnected by strips which hold the fasteners in a row as they are being moved into the magazine; and to provide a fastener driving tool which is able to use bulk type fasteners which are loosely supplied as well as such fasteners which are held in a row by strips or the like.

SUMMARY OF THE INVENTION

According to the invention there is provided a driving tool for fasteners having a shaft. The driving tool comprises an ejector channel wherein a driving rod is guided for movement between a rest position and a driving position. The ejector channel cooperates with a magazine merging or entering into the ejector channel. A separator mechanism is operatively arranged between the ejector channel and the magazine and the separator mechanism comprises a separator member which is movable between a locking position in which it reaches between the shafts of the fasteners, and a release position in which the separator member releases a fastener. A fastener holding means is arranged adjacent to the ejector channel in such a position, that it may hold an individual fastener temporarily in the ejector channel.

The separator member which reaches between the shafts of the fasteners makes sure that the first fastener enters safely into the ejector channel even if the fastener is of a lower quality. The fastener is held in the ejector channel by said holding means in such a manner that the fastener cannot fall out of the ejector channel when the driving tool is lifted. This again makes it possible to use a simple control for the separator piston connected to the separator member. The separator piston may be advantageously operated by the pressurized air of the return stroke to provide for the return of the driving rod which is connected to a driving piston. A direct connection between the air reservoir for the return stroke pressurized air and the cylinder of the separator piston obviates any further valve. The function of the driving apparatus according to the invention is thus rapid and safe.

The feature of the invention to arrest the separator member in its fastener release position has the advantage that the present apparatus may be used for driving fasteners secured by strips in a row, for example, nail strips or screw strips.

According to the invention fasteners loosely present in the magazine as well as fasteners held in a row by securing strips may be handled by the magazine slide member which transports the fasteners under the force of a spring from the magazine into the ejector channel. Thus, the driving apparatus according to the invention is universally usable for loosely held fasteners as well as for fasteners held in a row by securing strips. Moreover the present apparatus may be used for an effective driving operation in any desired direction including an overhead direction without any trouble.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
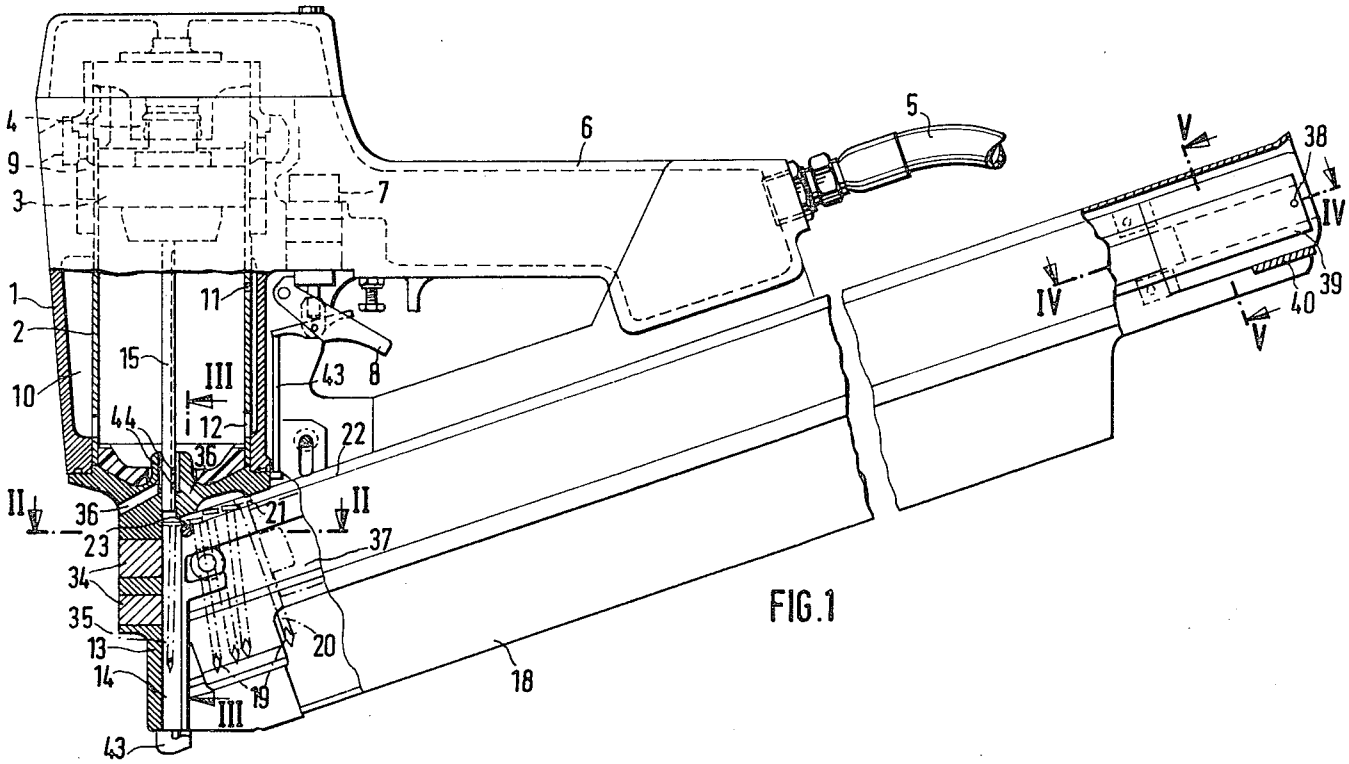
FIG. 1 illustrates a side elevational view of a driving tool according to the invention partially in section.

As shown in FIG. 1, a cylinder 2 is operatively supported in a housing 1. A strike piston 3 is slidably supported in the cylinder 2 to be driven by pressurized air. The strike piston 3 is held in its rest position shown in FIG. 1 by means of a rubber elastic latching mechanism 4. Air under pressure is supplied through a connecting hose 5 and through a hollow handle 6 secured to the housing 1. The hose 5 is in turn connected to an air pressure source not shown.

A trigger valve 7 may be operated only when a trigger lever 8 as well as a work piece sensor 43 are moved out of their rest position into their work position. The trigger valve 7 controls in a known manner a tubular slide valve 9 arranged concentrically relative to the cylinder 2 as shown in my earlier U.S. Pat. Nos. 3,969,988 and 3,969,989. The control of the slide valve 9 is such that the pressurized air can enter into the space above the strike piston 3 in the cylinder 2 to move the strike piston 3 into its work position shown in FIG. 3 or to vent the cylinder space above the strike piston 3 after the work stroke has been completed.

The return stroke of the strike piston 3 is accomplished by means of an air storing member 10 surrounding the cylinder 2. The air storing member 10 is filled with air during the work stroke through a bore 11 in the cylinder 2. The air in the storing member 10 enters through a bore 12 into the space below the strike piston 3 after the space above the strike piston 3 has been vented whereby the strike piston 3 is returned to its rest position shown in FIG. 1.

A cylinder foot 13 is secured by means of screws to the housing 1. The cylinder foot 13 comprises an ejector or discharge channel 14. A driving rod 15 is movable in the ejector channel 14. The driving rod 15 is operatively connected with the strike piston 3.

Figure 2:
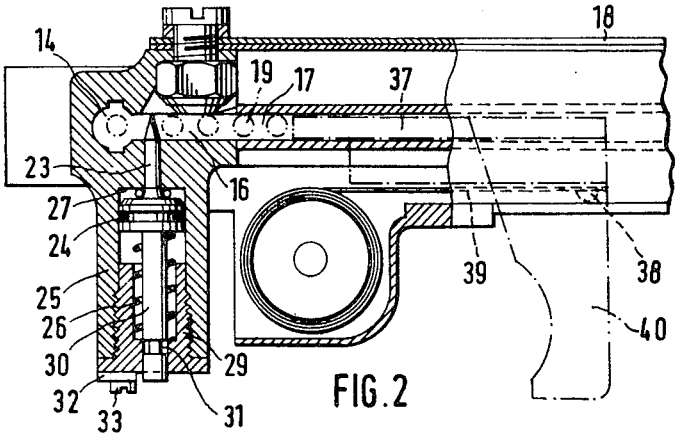
FIG. 2 is a sectional view along section line II—II in FIG. 1.

As shown in FIG. 2 the ejector channel 14 is operatively connected to a guide slot 16. A magazine 18 merges into this guide slot 16 with its guide chute 17. The magazine 18 is connected with the cylinder foot 13 and with the handle 6. The central plane of the guide chute 17 extends through the longitudinal axis of the ejector channel 14.

Figure 5:
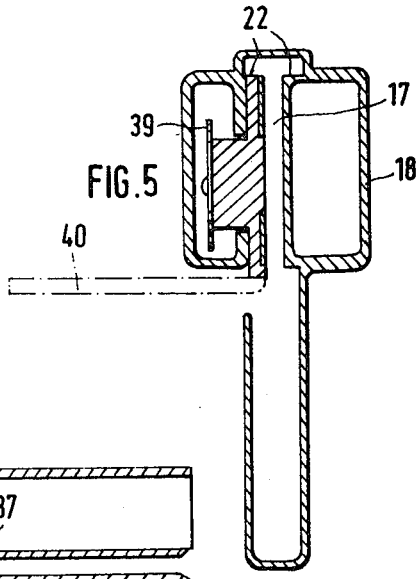
FIG. 5 is a sectional view along section line V—V in FIG. 1.
Figure 4:
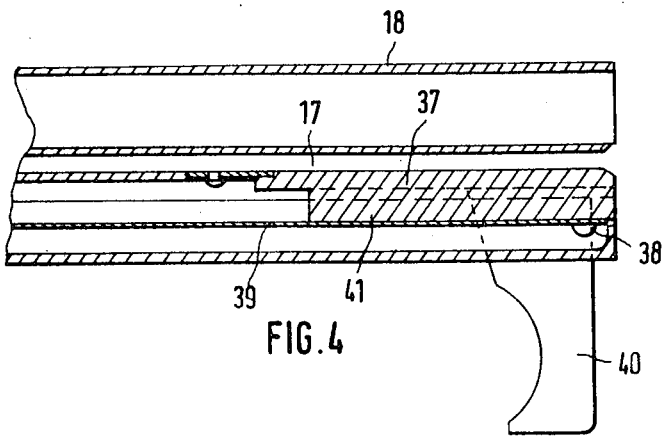
FIG. 4 illustrates a sectional view along section line IV—IV in FIG. 1 wherein the magazine push member is shown in its end position.

Nails 19 are loosely held ready in the magazine 18. The shafts 20 of the nails are guided in the guide chute 17 and the heads 21 of the nails rest on two support surfaces 22 arranged opposite each other, please see FIG. 5. The support surfaces 22 are inclined relative to the longitudinal axis of the ejector channel 14. As shown in FIG. 4, the guide chute 17 is open toward the rear.

Figure 3:
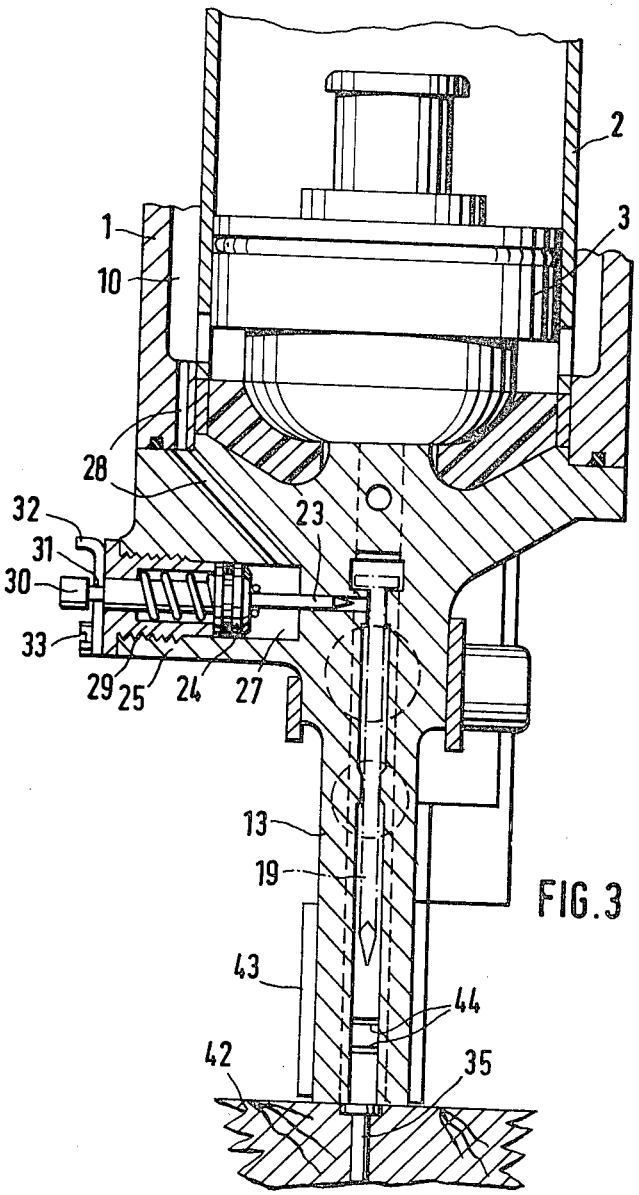
FIG. 3 is a sectional view along section line III—III in FIG. 1.

FIG. 2 shows a separator member 23 which has a foreward pointed tip. The separator member 23 reaches into the guide slot 16 when the member 23 is in the nail arresting position shown in FIG. 2. Thus, the separator member 23 separates the ejector channel 14 from the guide chute 17. The separator member 23 is operatively connected with a separator piston 24 which is movably supported in a separator cylinder 25. The separator member 23 is biased into the arresting position by means of a pressure spring 26. As shown in FIG. 3, the cylinder space 27 is connected to the air storage 10 through connecting bores 28.

The separator cylinder 25 is closed by a closure screw 29. A guide pin 30 is supported in the closure screw 29 and connected to the separator piston 24. The guide pin 30 is provided with a ring groove 31 arranged for cooperation with a locking or arresting member 32. As shown in FIG. 3, the locking member 32 is secured to the closure screw 29 by means of a screw 33. By loosening the screw 33 the locking member 32 may be tilted out of the position in which it engages the ring groove 31.

As shown in FIG. 1, a holding mechanism 34 is arranged in the cylinder foot 13. The holding mechanism 34 comprises two permanent magnets, which are effective in the ejector channel 14 in order to hold the first nail 35 in the ejector channel as long as the strike or drive rod 15 is in the rest position. Instead of the permanent magnets the holding device may comprise a cam which is spring biased to reach into the ejector channel 14. Spring biased guide jaws may be used instead of the spring biased cam. Such guide jaws are not shown since they are known as such. Exhaust bores 36 are arranged in the cylinder foot 13 above the holding device 34. These exhaust bores 36 provide a discharge means for any air under pressure remaining after the completion of the return stroke of the strike piston 3. Thus, such remaining air under pressure is prevented from blowing the first nail 35 out of the ejector channel 14.

As shown in FIGS. 1 and 2 a magazine slide 37 indicated by dash-dotted lines is movably supported in the guide chute 17. A roll-up spring 39 is secured to the magazine slide 37 by means of a rivet 38. The roll-up spring 39 may be rolled-up in the magazine 18 and is effective on the magazine slide 37 in the direction toward the discharge or ejector channel 14. A handle 40 is connected to the magazine slide 37 whereby the latter may be shifted toward the end of the magazine 18 where the slide 37 may be held in a lateral pocket 41 as shown in FIG. 4. Thus, when the slide 37 is in the pocket 41 the guide chute 17 is open rearwardly.

The apparatus according to the invention operates as follows. First, the open rear end of the guide chute 17 of the magazine 18 is operatively connected to a supply apparatus for the fasteners. The supply apparatus is not shown, however, such supply apparatus is well known in the art and it keeps the nails ready for transfer into the guide chute 17 in a sorted manner. Instead of nails with smooth shafts it is quite possible to use nails with rifled shafts, screw nails, nail screws, screws or the like. Upon removal of the driving apparatus from the supply apparatus, the nails 19 slide along the guide chute 17 whereby the nails are suspended at their heads 21 and the sliding is caused by gravity until the first nail is stopped by the separator member 23. The magazine slide 37 may now be lifted out of the pocket 41 and inserted into the guide chute 17, whereby the slider 37 presses the nails 19 under the effect of the roller spring 39 in the direction toward the ejector channel 14.

The coupling hose 5 is now connected to a source of air pressure not shown. If now the driving apparatus is pressed against a work piece 42 as shown in FIG. 3, the work piece sensor 43 is shifted upwardly in preparation of the trigger mechanism. If now the trigger lever 8 is actuated, the driving stroke of the driving piston 3 is released in a known manner. The driving piston 3 thus takes up the work position shown in FIG. 3 without, however, driving a nail because no nail is yet present in the ejector channel 14. In this position of the driving piston 3, however, air under pressure in the cylinder 2 enters through the bore 11 into the air storage 10 and through the bore 28 into the separator cylinder 25 whereby the separator piston 24 and thus the separator member 23 are shifted outwardly by this air pressure against the effects of the pressure spring 26. Thus, the separator member 23 now opens up the guide slot 16 in which a nail 19 is present whereby the first nail 35 is pressed in the direction of the ejector channel 14 until its head 21 contacts the driving rod 15. However, under the effect of the spring biased magazine slide 37 the nail shaft 20 takes up a position which points away rearwardly from the ejector channel 14.

If now the trigger lever 8 is released, the inner space of the cylinder 2 is disconnected from the air pressure source in a known manner, and simultaneously the inner space is vented. Thus, the air pressure stored in the air storage 10 can move the strike piston 3 into its rearward rest position where it is arrested by the arresting mechanism 4. During this return movement of the driving rod 15 the latter is effective on the nail head 21 of the first nail 35 due to frictional forces and facilitated by the cross grooves 44 in the driving rod 15 in such a manner that the shaft 20 of the first nail 35 tilts in the clockwise direction until the shaft rests against the wall of the ejector channel 14 opposite the guide slot 16. In this position the nail is held by the holding device 34 comprising two permanent magnets. If now the next driving stroke is released as described, the driving rod 15 will drive the nail 35 into the work piece 42. The air pressure from the air storage 10 again displaces the separator member 23 so that the next nail is pressed against the driving rod 15 which is now in the driving-in position. Upon the completion of the return stroke of the driving rod 15 the next nail enters into the ejector channel 14 as described and the driving apparatus is ready for the next driving stroke.

If the separator member 23 is to be arrested in its nail release position, it is necessary that the locking member 32 as shown in FIGS. 2 and 3 is tilted in the clockwise direction until it engages the ring groove 31 of the guide pin 30. Thus, the guide chute 17 is now opened relative to the ejector channel 14 as long as the member 32 is in the retaining position, whereby it is possible to use the driving apparatus for driving fasteners, such as nails which are interconnected by connecting strips.

It is possible to mechanically couple the driving rods 15 with the separator member 23 in such a manner that the latter is pushed into its nail releasing position when the rod 15 is in its driving position.

If separator member 23 is operatively connected to a screw driving apparatus known as such, then it is possible to drive screws which are loosely held or stored in the magazine 18. The operation of the separator member 23 may then take place in such a manner that the driving member of the screw driving apparatus shifts the separator member 23 into its screw releasing position when the driving member moves toward the work piece.

Although the invention has been described with reference to specific example embodiments, it will be appreciated, that it is intended, to cover all modifications and equivalents within the scope of the appended claims.

What is claimed is:

1. A driving apparatus for driving fasteners having shafts into a work piece, comprising housing means, fastener driving means in said housing means, said fastener driving means comprising driving rod means and ejector channel means, said driving rod means being movable in said ejector channel means between a rest position and a driving position, said apparatus further comprising magazine means operatively connectable to said housing means for supplying fasteners into said ejector channel means, separator means operatively arranged relative to said magazine means and said ejector channel means, said separator means including a separator member movable between a fastener stop position and a fastener releasing position, said apparatus further comprising holding means so positioned relative to said ejector channel means and relative to said separator means as to hold a fastener released by said separator member in said ejector channel means, said apparatus further comprising pressurized air storage means operatively connected to said fastener driving means for temporarily storing air under pressure resulting from a driving movement of said driving rod means for returning said driving rod means into said rest position with the aid of said air under pressure, and separator control means comprising cylinder means operatively connected to said pressurized air storage means and piston means in said cylinder means, said piston means being operatively connected to said separator member.

2. The apparatus of claim 1, wherein said piston means operatively connected to said separator member controls the separator member in response to the operation of said driving rod means to release a fastener when said driving rod means is in its driving position and to move said separator member into a fastener stopping position just prior to said driving rod means reaching its rest position.

3. The apparatus of claim 1, further comprising arresting means operatively connected to said separator member for holding the separator member in an inactive position whereby the apparatus may use fasteners loosely held in said magazine means when said separator member is in an active position and fasteners interconnected to each other by holding strips when said separator member is in an inactive position.

4. The apparatus of claim 3, wherein said arresting means comprise a locking element operatively arranged for holding said piston means of said separator control means in a withdrawn position in which the respective separator member is held in said fastener releasing position for using fasteners which are interconnected by a strip.

5. The apparatus of claim 1, wherein said magazine means comprise fastener guide chute means, slide means operatively arranged in said fastener guide chute means, and biasing means operatively connected to said slide means for urging the slide means in a direction toward said ejector channel means and wherein said slide means is arranged for removal from said fastener guide chute means in a direction away from said ejector channel means.

6. The apparatus of claim 5, wherein said slide means is removable from said fastener guide chute means when said slide means are in an end position away from said ejector channel means.

7. The apparatus of claim 5, wherein said magazine means comprise, in addition to said chute means, recess means for holding said slide means in an inoperative position.

* * * * *